US006519859B2

(12) United States Patent
Beshires

(10) Patent No.: US 6,519,859 B2
(45) Date of Patent: Feb. 18, 2003

(54) REAR SIGHT ATTACHMENT FOR ARCHERY BOWS

(76) Inventor: Anthony Alan Beshires, 1863 N. Main St., Water Valley, MS (US) 38965

( * ) Notice: Subject to any disclaimer, the term of this patent is extended or adjusted under 35 U.S.C. 154(b) by 18 days.

(21) Appl. No.: 09/756,606

(22) Filed: Jan. 8, 2001

(65) Prior Publication Data

US 2002/0017027 A1 Feb. 14, 2002

Related U.S. Application Data

(60) Provisional application No. 60/222,633, filed on Aug. 3, 2000.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS 4,915,088 A * 4/1990 Powers ..... 124/87
4,977,678 A * 12/1990 Sears ..... 33/265
4,982,503 A * 1/1991 Land ..... 33/265
5,048,193 A * 9/1991 Hacquet ..... 33/265
5,398,420 A * 3/1995 Kleinschmidt ..... 124/87
5,579,752 A * 12/1996 Nelson et al. ..... 124/87
5,671,724 A * 9/1997 Priebe ..... 124/87
6,098,608 A * 8/2000 Oshlick ..... 127/87

* cited by examiner

*Primary Examiner*—Christopher W. Fulton

(57) ABSTRACT

An archery sight comprising an elongated bracket secured to the archery bow's front sight threaded bore, and extends rearward of the bow's riser. There being at the end of the bracket a 90 degree bend that forms a laterally extending shelf. The shelf has a slot into which is mounted a vertical standing rear sight pin that is shaped like the letter Y and is attached by means of threaded bore. By aligning the distal end of the selected front sight pin or pins (by others) into the exact bottom of the junction of the Y shaped pin, the bow man is able to control the course of the arrow quite accurately.

5 Claims, 3 Drawing Sheets

REAR SIGHT ATTACHMENT FOR ARCHERY BOWS

CROSS-REFERENCE TO RELATED APPLICATION

This application claims the benefit of U.S. Provisional Patent Application Ser. No. 60/222,633 filed Aug. 3, 2000.

FIELD OF INVENTION

This invention relates to aiming sights for archery bows, in particular to a rear sight to be used with a front pin sight assemblies all ready in use on todays modem compound hunting bow.

BACKGROUND OF THE INVENTION

It is well known that rear sights may be positioned on bows to aim the arrow shot therefrom. Rear bow sights are shown in U.S. Pat. No. Des. 423,627; U.S. Pat. Nos. 4,159,575; 4,215,484; 4,977,678; 5,040,301; 5,864,958; and 6,003,233, most being bulky in nature work in conjunction with their front sight, sight assemblies. Many incorporate a rear aperture that constricts the users sight picture to the intended target. Some rear sights have cross hair type aiming points which are useless in low light conditions. There are some rear sights with appendages bolted on that will vibrate loose. All of the current rear sights have separate rear guard that further inhibits the archers sight picture to the target. Many of these sights used require the archer to change his anchor point to an uncomfortable position due to these sights limited adjustability to each individual archer.

It would be desirable, therefore to provide a light weight rear bow sight that can be used with a variety of front sights by other manufactures. A rear sight that will eliminate the constricting nature of the peep or aperture sights. A rear sight that is fully adjustable to the individual archer and can be locked securely in place. A rear sight that enhances the users ability to shoot at targets or intended game animals in low light conditions and will mount on virtually all modem and early model archery bows.

The compound bow has been produced and long known to the prior art to be a difficult weapon to master the skill necessary to shoot accurately and consistantly. Modem hunting bows rely on a front pin sight assembly and a peep sight in the bowstring as a means of sighting in on the target at predetermined distances. Hunters have relyed on swinging pedulum sights to make shots at game from elevated stand positions. The pendulum type sights only work at certain stand heights and angle to game on the ground. These pendulum sights try to compensate the archer for poor bow placement caused by the angle to the game on the ground.

Both pin and pendulum front sights require the use of a peep sight in the bow's string. Due to the difficulty in the human eyes ability to center the front sights in the peep and on the target, the need for a more accurate means of sighting and aligning the bow to the eye is well known to the art.

OBJECTS OF THE INVENTION

It is the object of the invention to provide an improved rear sighting option attachable to a variety of bows.

Another object is to not block the archer's view in aiming at a target or hard to see animal.

Yet another object of the invention is to bring the eye to the target plane and arrow to target plane closer together for extremely accurate shot placement.

Still another object is to replace the string peep and swinging pendulum with a solid sighting system, incorporating front pin sight assemblies (by others) and the rear sight device of my invention.

SUMMARY OF INVENTION

My invention as seen in the illustration, is comprised of three (3) basic parts solidly attached to form a very rigid rear sighting anchor point.

The bracket has a unique 90 degree bend and adjustment slot which allow the bracket to be mounted to the archery bow via mounting holes in the bow. Angled cut sides and the 90 degree bend turns bracket across inside of the bows riser, to provide a narrow shelf to which the rear sighting stud is attached with a single nut.

The rear sight bracket may be lowered or raised to the preference of the archer and necessary clearances needed for the arrow's fletching to pass unrestricted underneath the bracket's tail section.

By bringing the bracket down as close as possible to the arrow, the archer is lowering the eye to the target plane closer to the arrow's flight plane.

This produces a sighted in arrow that travels along a parrallel closer to the eye's parrallel to the target. At the point where the archery bow is at full draw (just before arrow is released) the nocking point on the bow string and the shooters aiming eye are for most archers four to six inches apart, while aiming with a traditional "peep sight".

My invention will bring the "eye to nock" distance to 1½ to 3 inches. This will reduce the effect of the eye to target, arrow to target planes crossing at distances beyond what the front pin sights are set.

Also because the archer is sighting along the arrow's flight path from a fixed position on the archery bow. The archer will be able to make downward angled shots at game animals form an elevated stand, because the eye to bow position will not change.

DETAILED DESCRIPTION

Figure 1:
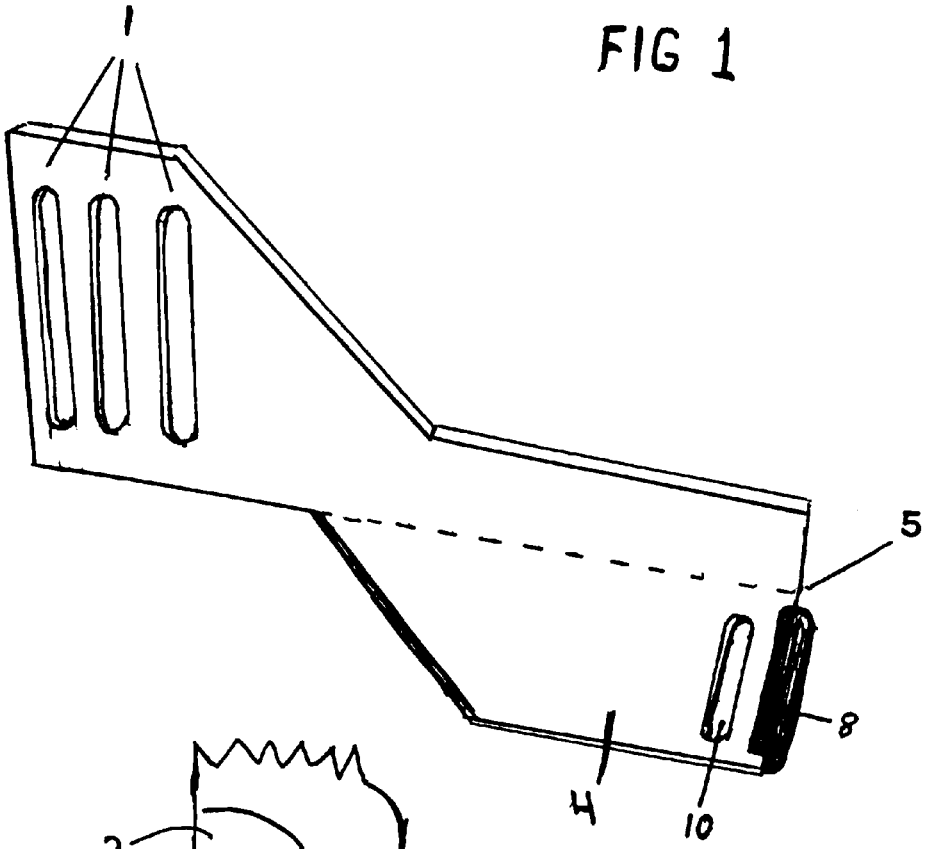
FIG. 1. is a side elevational view of my rear sight bracket showing placement of slots in riser end and tail section of said bracket. Also placement of 90 degree brake or bend and rubber string guard are seen.
Figure 4:
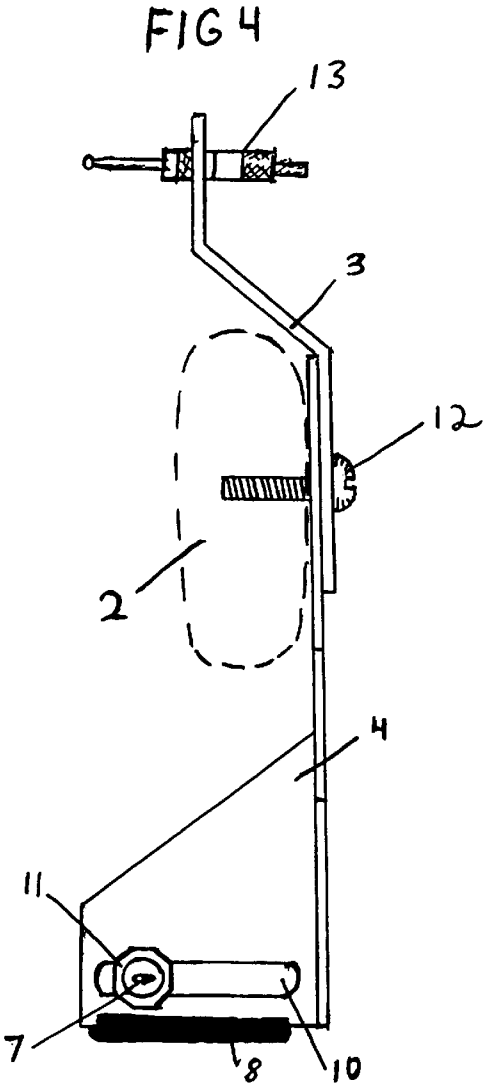
FIG. 4. is a top view showing tail section, mounting and front sight (by others)

One (1) referring to FIG. 1, the rear sight bracket is a single piece of aluminum with slots 1 cut into the foremost part of the bracket. One or more slots will align with screw holes in the bow's riser 2 of FIG. 2. This section of the bracket is in a vertical position when mounted to the bow. In FIG. 4, the screws which mount front sight bracket 3 to the bow's riser 2 will pass threw slots 1 in the rear sight bracket and securely fasten bracket to bow.

Figure 2:
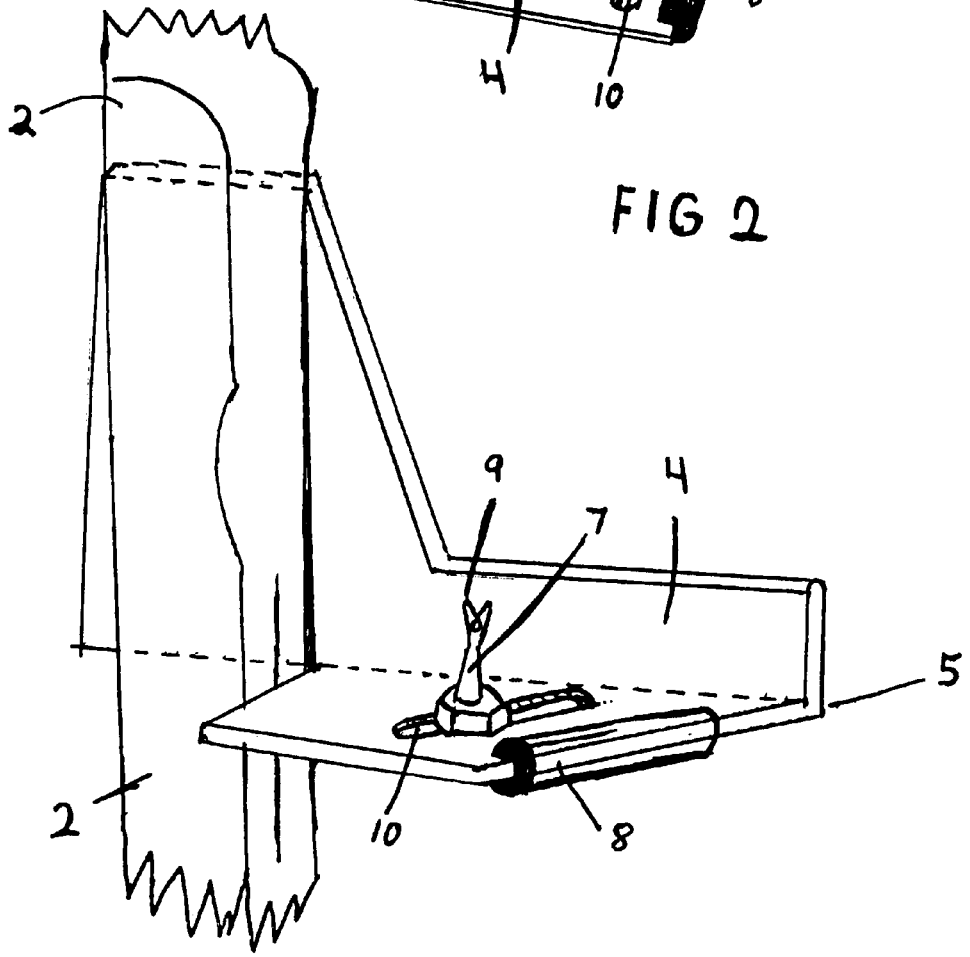
FIG. 2. is a side elevational view showing bracket attached to bow's riser and rear sight stud in place, as viewed on a right handed bow. The bow is only fragmentarily depicted.
Figure 3:
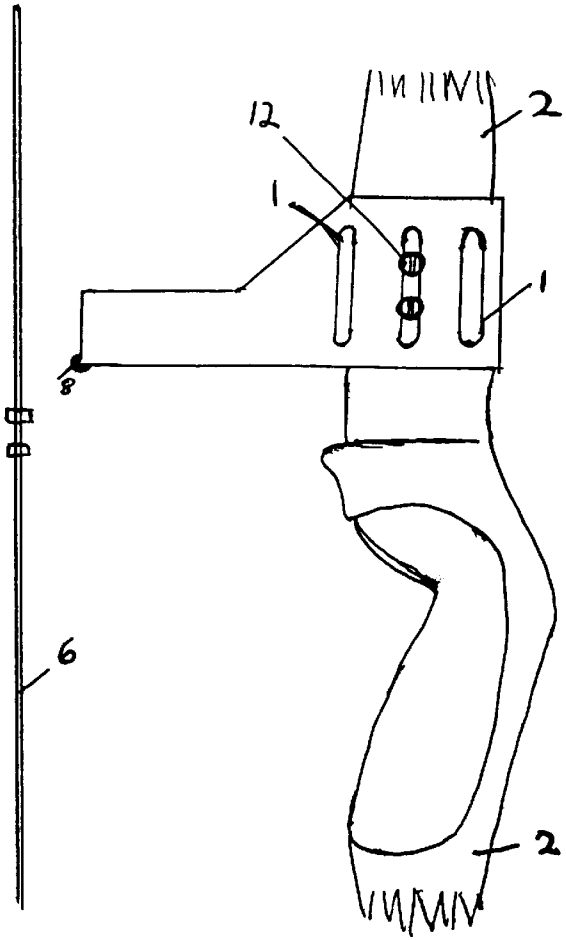
FIG. 3. is as viewed from the right side of the bracket shown mounted to fragmentarily depicted bow riser and relation to bow's string.

As shown in FIG. 1, FIG. 2, and FIG. 4, the tail 4 extends rearward from the riser 2 and has a 90 degree break or bend 5 and turns across the inside of the riser 2 horizontally and extends back toward the string 6 as shown in FIG. 3. The 90 degree bend at 5 produces a horizontal shelf and is a stiffener to eliminate horizontal and vertical shifting and bending of rear sight bracket.

Also there is a single slot in the tail section 4 for mounting and adjusting the rear sight stud 7 from left to right as determined by the preference of the archer.

Figures 5, 6:
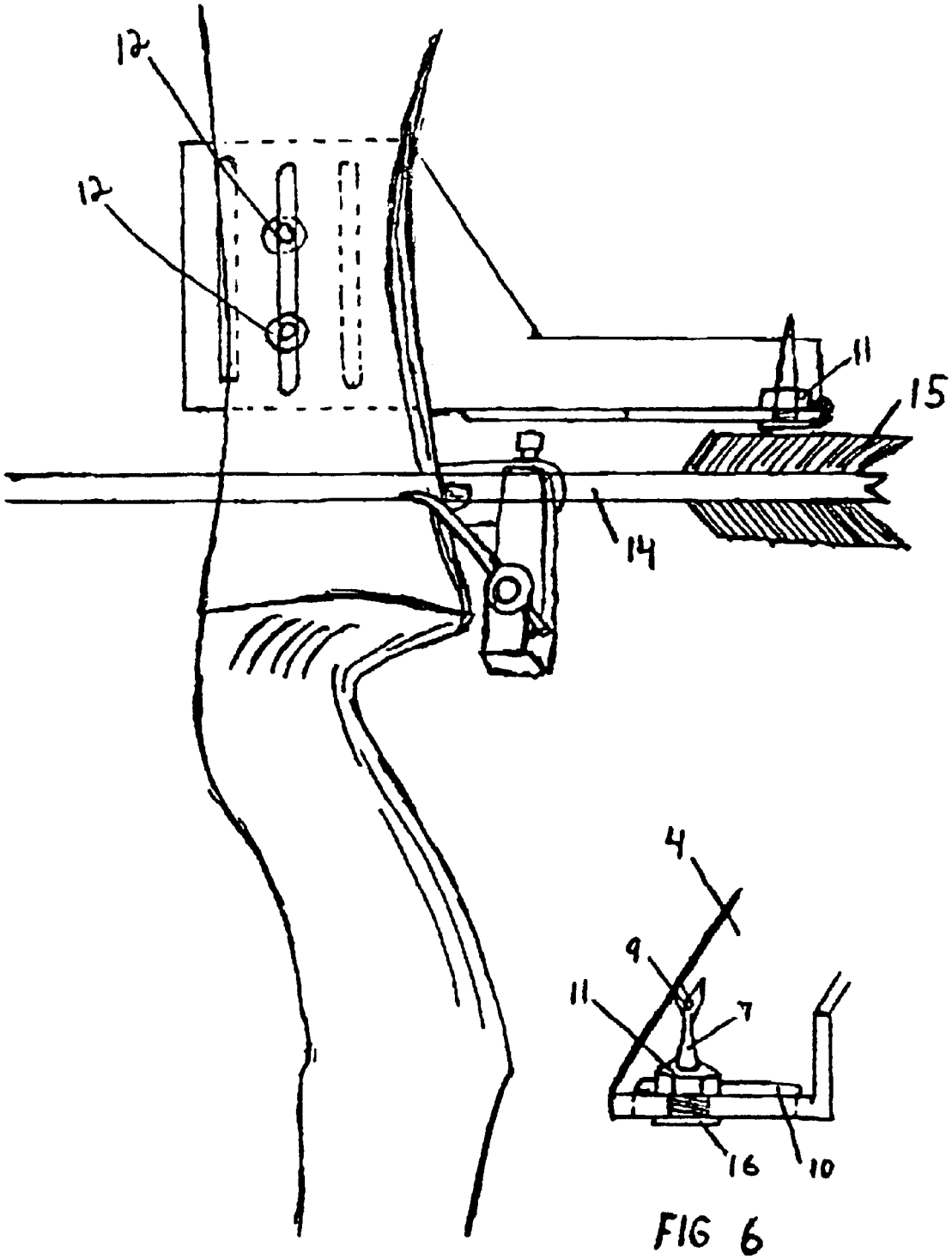
FIG. 5. is a detailed left view showing sight relation to arrow.
FIG. 6. is a detailed view of tail sections and rear sight stud.

On the tail section 4 there is a rubber string guard 8 that acts as a serving point where the string 6 will release the arrow in precisely the same point everytime. The rear sight stud 7 has a flat seat 16 as shown in FIG. 6 and is threaded about three eights of an inch up from stud seat 16, then tapers down to form a conical pin shape, the end of which has an enlarged head shaped like the letter Y. There is a small hole drilled at the exact bottom of the Y. The hole will accept fiber optic material to allow the archer to make shots at game animals in low light conditions.

Referring again to FIG. 6, the rear sight stud 7 is placed up threw the slot in the tail section 4 of the bracket and is secured with nut 11 which passes down over the head and tapered portion of the stud 7 to secure to the threads extending threw the slot 10 in the tail section 4 bracket slot 10.

To achieve proper bow placement in the archers hand, it is desirable that the rear stud 7 is placed in a position in the tail section slot 10 so that when aligning the rear sights V shaped stud head 9 with others front pin sight 13, FIG. 4 and target at bows fill draw, no noticable canting or wrist twisting is felt.

Referring to FIG. 3, the rear sight is adjusted vertically by loosening mounting screws 12 in the bows riser 2 and raising or lowering entire rear sight bracket and allowing rear sight bracket to slide along screws 12 by slots 1 in riser end of bracket.

As seen in FIG. 5, the rear sight bracket can be lowered to a position to allow clearance of arrow's 14 fletching 15 but not allow any contact between arrow's fletching 15 and rear bracket.

Retighten screws 12 in rear sight bracket. After positioning rear bracket, all adjustments made to zero in arrow 15 to intended target will be made by adjusting front pin sights (by others) left or right and vertical up and down until arrows are striking the intended impact point on the target, at known distance.

While it is obvious that the present invention is not limited to the sole embodiment described above, but encompass any and all changes or modifications without departing from the true spirit, scope and integrity of the invention. It is the purpose of the appended claims to cover all such changes or modifications which fall within the true spirit, scope and integrity of the invention.

Having described the invention, what is desired to be secured by a Letters Patent is:

I claim:

1. A rear sighting attachment for an archery bow including a riser portion and a bow string, and a front sight pin assembly; said rear sighting attachment comprising:

(a) a rear sight stud;

(b) rear sight support bracket including a front section and a tail section, said front section including bow attachment means for attaching said rear sight support bracket to said riser portion of said bow in a manner which allows up-and-down and back-and-forth adjustment of said rear sight support bracket on said riser portion of said bow, a portion of said tail section being bent at a 90° angle and forming a shelf having a rear edge, said tail section including rear sight stud attachment means for attaching said rear sight stud to said shelf in a manner which allows side-to-side adjustment of rear sight stud on said shelf; and (c) a string guard attached to said rear edge of said shelf of said tail section of said rear sight support bracket.

2. The rear sighting attachment of claim 1 in which said string guard is rubber.

3. The rear sighting attachment of claim 1 in which said bow attachment means includes three elongated slots in said front section of said rear sight support bracket.

4. The rear sighting attachment of claim 1 in which said rear sight stud attachment means include s an elongated slot in said shelf of said rear section of said rear sight support bracket.

5. The rear sight attachment of claim 4 in which said rear sight stud includes shaft for extending through said elongated slot in said shelf of said rear section of said rear sight support bracket, said shaft of said rear sight stud having a first end and a threaded second end; in which said rear sight stud has an enlarged head at said second end of said shaft thereof; in which said rear sight stud attachment means includes a threaded nut for screwing onto said threaded second end of said shaft of said rear sight stud; in which said first end of said shaft of said rear sight stud tapers down to form a small pin having a head with a pair of arms extending outwardly therefrom to form a shape like the letter Y and has a small hole at the precise bottom of the junction of the arms to accept fiber optic material.

* * * * *